US008021602B2

(12) United States Patent
Shima et al.

(10) Patent No.: US 8,021,602 B2
(45) Date of Patent: Sep. 20, 2011

(54) HEARTH CARRIAGE COUPLING STRUCTURE OF ROTARY FURNACE HEARTH

(75) Inventors: Shinji Shima, Kitakyushu (JP); Toshitaka Nakayama, Kitakyushu (JP); Tomoaki Shibata, Tokyo (JP)

(73) Assignees: Nippon Steel Corporation, Tokyo (JP); Nippon Steel Engineering Co., Ltd., Tokyo (JP)

( * ) Notice: Subject to any disclaimer, the term of this patent is extended or adjusted under 35 U.S.C. 154(b) by 375 days.

(21) Appl. No.: 12/226,033

(22) PCT Filed: Sep. 19, 2006

(86) PCT No.: PCT/JP2006/318889

§ 371 (c)(1), (2), (4) Date: Feb. 1, 2009

(87) PCT Pub. No.: WO2007/113929

PCT Pub. Date: Oct. 11, 2007

(65) Prior Publication Data

US 2009/0206529 A1 Aug. 20, 2009

(30) Foreign Application Priority Data

Apr. 4, 2006 (JP) ..... 2006-103171

(51) Int. Cl.
*F27B 9/30* (2006.01)

(52) U.S. Cl. ..... 266/177; 266/178; 266/287

(58) Field of Classification Search ..... 266/171, 266/177, 178, 180, 287
See application file for complete search history.

(56) References Cited

U.S. PATENT DOCUMENTS 3,501,135 A * 3/1970 Forslund ..... 432/59

FOREIGN PATENT DOCUMENTS

JP 7-055356 A 3/1995
JP 2001-254114 A 9/2001

* cited by examiner

*Primary Examiner* — Scott Kastler
(74) *Attorney, Agent, or Firm* — Birch, Stewart, Kolasch & Birch, LLP

(57) ABSTRACT

A rotary furnace hearth wherein a hearth carriage carrying a hearth comprises a plurality of hearth carriages respectively having propulsion systems, wherein adjoining hearth carriages are coupled by coupling bolts and nuts via spacers interspaced in a single row in a horizontal plane, whereby even if the hearth carriages deform due to heat at the time of operation, they are structured to be able to freely deform without mutual constraint in the event of curved deformation, so the hearth carriages are maintained in individually stable states at all times.

4 Claims, 6 Drawing Sheets

HEARTH CARRIAGE COUPLING STRUCTURE OF ROTARY FURNACE HEARTH

TECHNICAL FIELD

The present invention relates to a hearth carriage coupling structure of a rotary furnace hearth used when heating and reducing iron oxide briquettes comprised of iron ore, iron-making waste, or other iron oxide and a carbonaceous material or other reducing agent to produce direct reduced iron briquettes etc.

BACKGROUND ART

A rotary furnace hearth has a rotary hearth comprised of a hearth carriage having a propulsion system and on which hearth refractories are placed. The raw material is carried on the top surface of the hearth refractories and heated from above for sintering and reduction. This rotary hearth is constructed from a plurality of hearth carriages coupled in a ring from the viewpoint of fabrication and transport. As the coupling structure, a welded structure 50 welding members 14*a* and 14*b* of adjoining hearth carriages shown in FIG. 10 or a multi-stage bolted structure 52 using two rows of bolts 53 above and below shown in FIG. 11(*a*) has generally been used to make the hearth as a whole an integral structure.

However, the hearth carriages of this rotary furnace hearth receive heat from the inside of the high temperature furnace resulting in the temperature of the top surfaces becoming higher than the temperature of the bottom surfaces. As a result, if making the hearth carriages 10 an integral structure, as shown in FIG. 12(*a*), there was the problem that the difference in heat expansion caused the inner circumference side wheels 32 of the hearth carriages 10 to rise and excessive weight to concentrate at the outer circumference side wheels 33 and obstruct propulsion. Furthermore, there was the problem that the rise of the inner circumference side wheels 32, as shown in FIG. 13, caused interference between the hearth refractories and the wall refractories.

To avoid these problems, a structure enabling the hearth carriages 10 to freely move so as to give the state after heat deformation shown in FIG. 12(*b*) becomes necessary. The conventionally employed multi-stage bolt coupling structure 52 shown in FIG. 11(*a*) gives freedom to the coupling between hearth carriages by gradually loosening the nuts 54 in accordance with the heat deformation of the hearth carriages 10 and thereby enables heat deformation to be absorbed as shown in FIG. 11(*b*). However, when the furnace cools, the bolts and nuts loosen and therefore rattling unavoidably occurs between the hearth carriages 10. Therefore, there was the defect that while cold, the hearth cannot be kept circular and rotation is obstructed. There was the problem that to prevent this, it is necessary to adjust the amount of tightening of the bolts and nuts with each temperature change such as heating or cooling due to operation.

DISCLOSURE OF INVENTION

The present invention provides a hearth carriage structure enabling hearth carriages to freely move and coupling means for the same, that is, provides a hearth carriage coupling structure enabling the wheels to completely contact the rails even after the hearth deforms due to heat and thereby avoiding carriage breakage or accidents due to excessive load and not requiring adjustment of the amount of tightening of the bolts with each temperature change such as heating or cooling due to operation.

To solve the problems, the hearth carriage coupling structure of a rotary furnace hearth according to the present invention is characterized in that a hearth carriage carrying a hearth comprises a plurality of hearth carriages respectively having propulsion systems and in that adjoining hearth carriages are coupled by coupling bolts and nuts via spacers interspaced in a single row in a horizontal plane.

In the hearth carriage coupling structure, preferably a length of the spacers δ is made a length derived by the following formula:

$$\delta \geqq 0.5 \times \alpha \times \Delta T \times W \times l / L$$

α: Coefficient of linear expansion of main material of carriage frames

ΔT: Temperature difference between top surface and bottom surface of carriage frames at time of operation W: Length of carriages l: Distance from top surface of carriages to spacer (coupling bolt) mounting holes L: Height of carriage frames In the hearth carriage coupling structure, preferably wheels for movement of the hearth carriages are provided at the bottom of the hearth carriages and two are arranged at an outer circumference furnace wall side of each hearth carriage and one is arranged at an inner circumference furnace wall side or vice versa.

In the hearth carriage coupling structure, preferably a hearth refractory bed and the hearth carriages are separately provided and are coupled displaceably with each other.

In the hearth carriage coupling structure of the present invention, since the coupling bolts coupling the hearth carriages are arranged interspaced in a single row in a horizontal plane, even if the hearth carriages deform due to heat at the time of operation, they are structured to be able to freely deform without mutual constraint in the event of curved deformation, so the hearth carriages are maintained in individually stable states at all times. Further, since the coupling bolts couple the adjoining hearth carriages via spacers, clearance between the carriages is maintained by the spacers so that the adjoining carriages do not contact each other due to heat deformation at the time of operation. Furthermore, this clearance functions to minimize the change in distance of the couplings when the angle between the carriages changes. By adopting this structure, the coupling bolts can be kept to a bending stress and tensile stress within the allowable stress of the bolt matrix material.

If finding the length of spacers δ by $$\delta \geqq 0.5 \times \alpha \times \Delta T \times W \times l / L$$

it is possible to simply find the suitable spacer length δ enabling prevention of contact between adjoining carriages due to heat deformation.

In a structure where the hearth carriages have wheels for movement at their bottoms and each hearth carriage has two arranged at an outer circumference furnace wall side and one at an inner circumference furnace wall side or vice versa, even if the carriage frames deform due to heat along with operation, all of the wheels will contact the rails reliably at all times and the load applied to the rails and wheels can be kept constant, so the rails and wheels can be extended in lifetime.

In a structure where the hearth refractory bed and hearth carriages are separately provided and are coupled displaceably with respect to each other, even if the carriage frames of the hearth carriages deform by heat along with operation, the refractory bed is not deformed or effected by external force etc. Therefore, even if the carriage frames of the hearth carriages deform by heat, the hearth refractories will not be broken.

BRIEF DESCRIPTION OF THE DRAWINGS

In FIG. 6(*a*), wheels are attached to a foundation; in FIG. 6(*b*), wheels are provided at a bottom of a hearth carriage.

FIG. 11(*b*) is a view showing the coupling structure of FIG. 11(*a*) after heat deformation.

FIG. 12(*a*) schematically shows the conventional hearth carriage before heat deformation. FIG. 12(*b*) schematically shows the conventional hearth carriage after heat deformation.

BEST MODE FOR CARRYING OUT THE INVENTION

Figure 1:
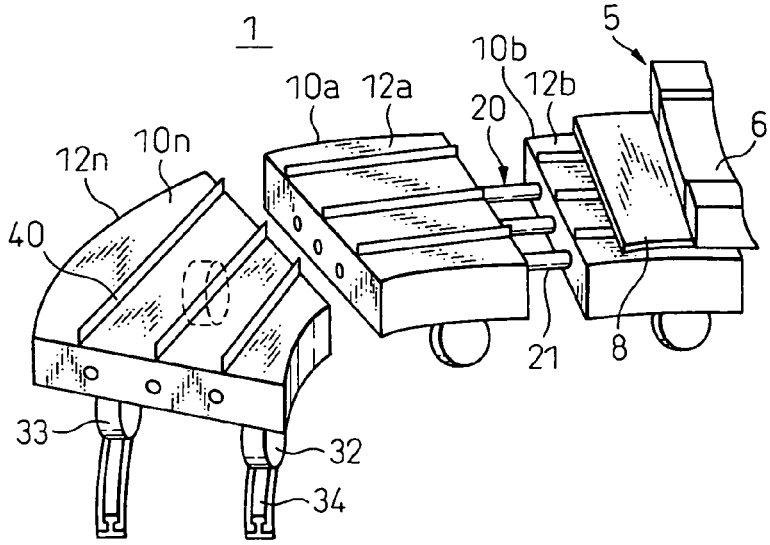
FIG. 1 is a perspective view schematically showing the structure of a hearth carriage of the present invention.

FIGS. 1 to 4 show an embodiment of the present invention. In this embodiment, a hearth 5 of a rotary furnace hearth 1 is comprised of a plurality of hearth carriages 10*a* to 10*n* coupled into a ring shape by a coupling systems 20. The hearth 5 is built from a refractory bed 6 and hearth material 7. The refractory bed 6 is arranged on the carriage top plates 8. Each hearth carriage 10 is mainly comprised of a carriage frame 12, a propulsion system 30, and carriage top plate support hardware 40.

Figure 11A:
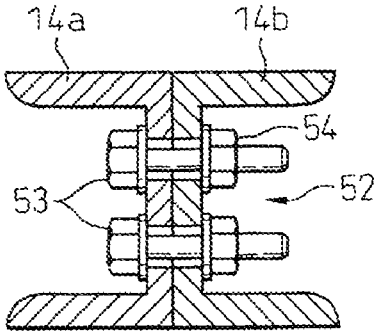
FIG. 11(*a*) is a view showing another example of a coupling structure of a conventional hearth carriage.
Figure 11B:
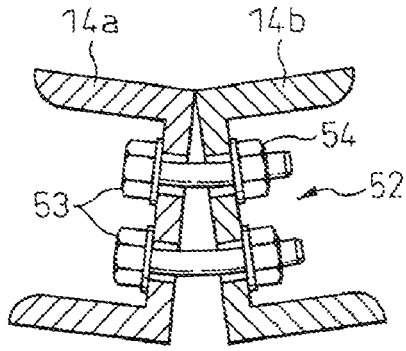
Figure 12A:
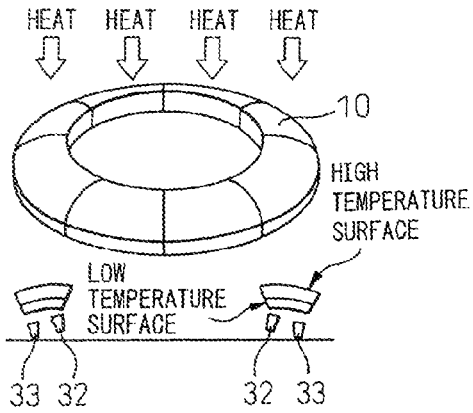
FIG. 12(*a*) and FIG. 12(*b*) schematically explain heat deformation of a conventional hearth carriage.
Figure 12B:
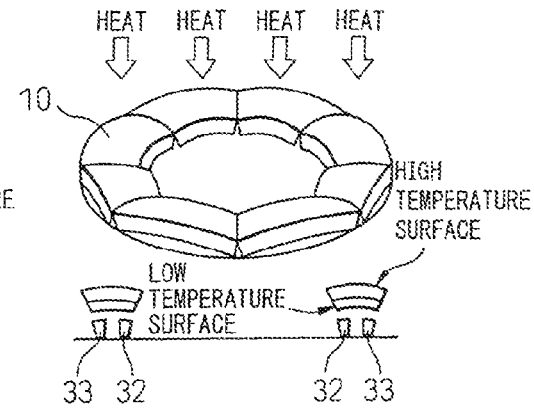
Figure 13:
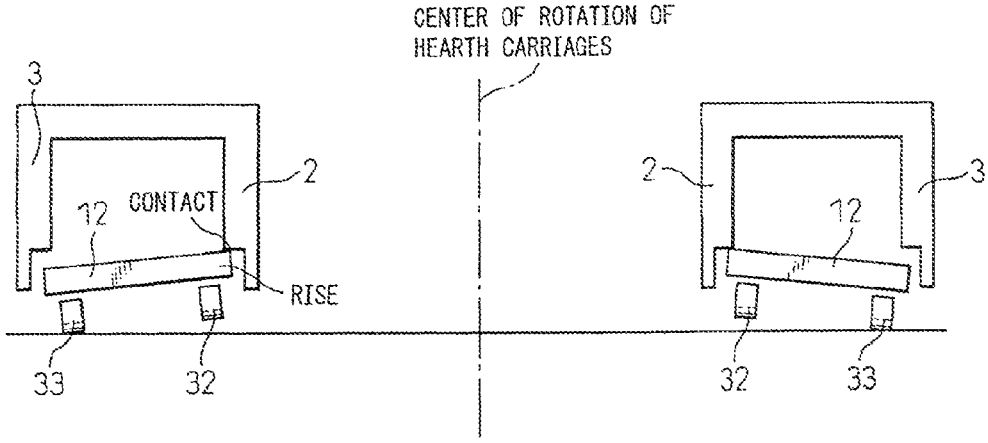
FIG. 13 is a schematic view explaining interference between a hearth refractories and wall refractories due to rising of inner circumferential wheels in a conventional hearth carriage.

Between the hearth carriages 10, as shown in FIG. 1, a plurality of the coupling systems 20 are arranged. The coupling systems are used to couple the adjoining hearth carriages 10 with each other. The plurality of the coupling systems 20 arranged between the carriages are aligned and arranged in a single row on the same horizontal plane and are not arranged in two rows in the vertical direction as in the example shown in FIG. 11. In FIG. 1, an example of arrangement of three coupling systems is shown.

Figure 3:
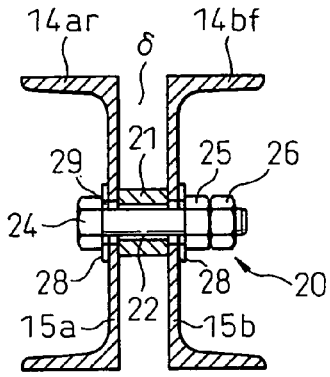
FIG. 3 is a detailed view of a coupling of the hearth carriage.

Each coupling system 20, as shown in FIG. 3, is comprised of a short tube-shaped spacer 21, a coupling bolt 24, and nuts 25 and 26. The spacer 21 is arranged in a space δ between webs 15*a* and 15*b* of a rear end vertical member 14*ar* of a front side carriage frame 12*a* and a front end vertical member 14*bf* of a rear side carriage frame 12*b*, while the coupling bolt 24 is arranged passing through the bolt holes 29 provided in the webs and an axial bore 22 of the spacer 21 and fastened by the nuts 25 and 26 to couple the hearth carriages 10*a* and 10*b*.

In the state where the operation is stopped (ordinary temperature), as shown in FIG. 3, the webs 15*a* and 15*b* are held vertical and parallel to each other and the front faces of the two ends of the spacer 21 contact the surfaces of the webs 15*a* and 15*b*. At this time, the space δ between the webs 15*a* and 15*b*, that is, the length of the spacer 21, is set based on past operations or calculation of the amount of heat deformation explained later to a size whereby the adjoining hearth carriages 10 will not contact each other due to heat deformation at the time of operation.

The spacer 21 is not limited to one of a short tube shape such as shown in FIG. 3 and may also be a ring-shaped disk. Further, as the material of the spacer 21, one having a strength able to withstand the compressive stress applied to the spacer 21 at the time of heat deformation of the carriages accompanying operation and a heat resistance temperature of 200 to 250° C. or more is sufficient. One made of general steel can sufficiently withstand use.

Note that, in FIG. 3, washers 28 are arranged between the webs 15*a* and 15*b* and the head of the bolt and nuts. The example of using two nuts was shown, but the present invention is not limited to this.

Figure 4:
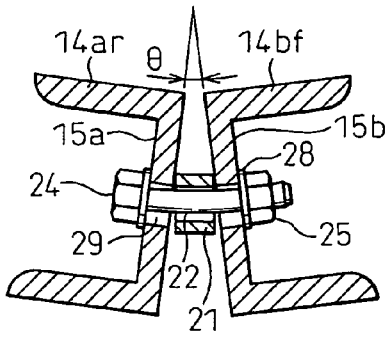
FIG. 4 is a view explaining the action of the coupling of the hearth carriage of the present invention.

In such a configured hearth carriage coupling structure, the spacer 21 sandwiched between the hearth carriages, as shown in FIG. 4, maintains the clearance of the hearth carriages so that the adjoining carriages do not contact each other due to heat deformation at the time of operation. This clearance has the action of keeping the change in distance of the coupling to a minimum when heat deformation of the hearth carriages causes a change in the angle θ between the two facing surfaces of the rear end vertical member 14*ar* and front end vertical member 14*bf*. Due to this structure, it is possible to minimize the elongation of the coupling bolt 25 coupling the hearth carriages by having almost all of the displacement of the coupling faces of the carriages absorbed by the bending and elongation of the coupling bolt 24 whereby just a slight rattling occurs in coupling of the carriages. As a result, the individual carriage frames can deform relatively freely. Further, just nuts 25 are used to initially fasten and adjust the coupling bolt 24. No readjustment of the amount of fastening is required with each temperature change of preheating, cooling, etc.

By using a plurality of these coupling systems 20 on a horizontal plane, it is possible to suppress the bending and tensile stress of the coupling bolts 24 to within the allowable stress of the coupling bolt matrix material.

Figure 2:
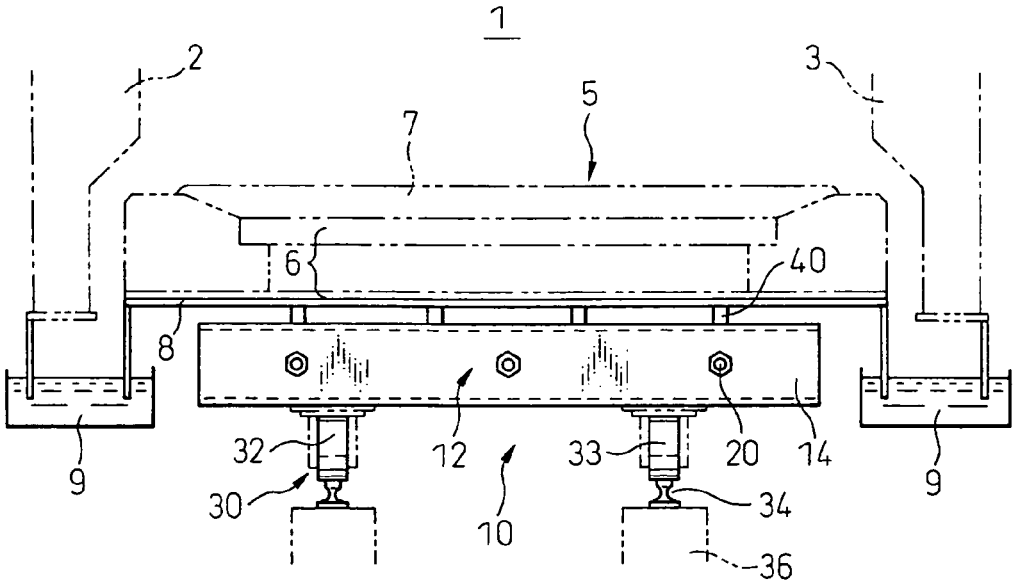
FIG. 2 is a front view of said hearth carriage.
Figure 5:
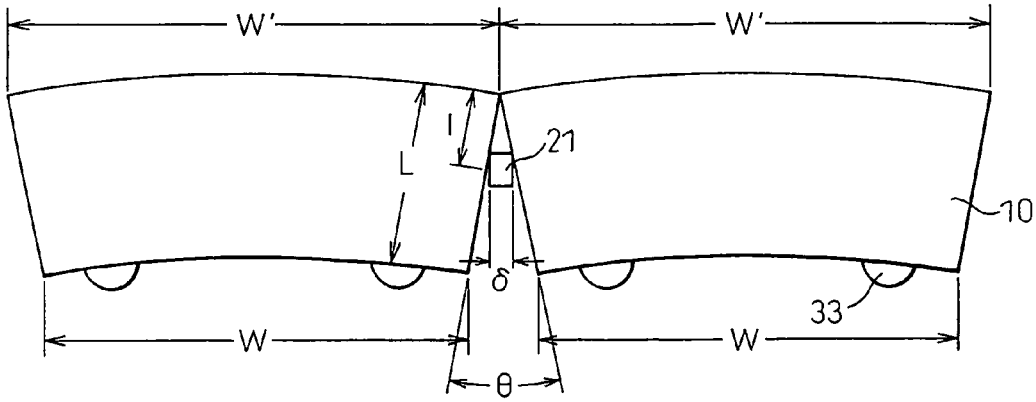
FIG. 5 is a view explaining the relationship of the length of a spacer, dimensions of a hearth carriage, temperature difference between a top and bottom of a carriage, spacer position, etc. of the present invention.

In each above coupling system, the actual clearance δ (=length of spacer) should be set as follows: As shown in FIG. 1 and FIG. 2, the hearth material 7 is placed on the top of the hearth carriages 10 via the refractory bed 6. Above the hearth material 7, a raw material for reduction use (not shown) is placed. This raw material is heated, sintered, and reduced while the hearth rotates. At this time, as shown in FIG. 5, the longitudinal direction distance W of the carriages 10 before operation (at time of ordinary temperature) becomes W' due to the heating and expansion of the tops. On the other hand, the bottom surfaces of the carriages do not rise in temperature as much as the top surfaces. Due to this, the carriages 10 bend to upwardly projecting shapes as shown in the drawing. In the state shown in FIG. 5, the elongation W' of the two carriages causes the top ends of the adjoining carriages to contact each other. This is the allowable limit of the deformation.

When the slant of the end faces of the two carriages is defined as a slant by an angle θ from each other about the spacer 21, the length δ required in the theory of the spacer 21 for preventing the tops of the adjoining carriage ends from contacting each other becomes:

$$\delta \geqq l \times \tan\theta \quad (1)$$

where "l" is the distance from the top surface of a carriage to a mounting hole of the spacer (coupling bolt).

On the other hand, the clearance at the bottom at the ends of the two carries in the same state as the above becomes:

$$W' - W = L \times \tan\theta \quad (2)$$

where, L is the height of the carriage frame. Further, simultaneously $$\alpha \times \Delta T \times W = L \times \tan\theta \quad (3)$$

where, α is a coefficient of linear expansion of the main material of the carriage frame, and ΔT is a temperature difference between a top surface and bottom surface of a carriage frame at the time of operation. From equation (3) and the above equation (1), $$\delta \geqq \alpha \times \Delta T \times W \times l/L \quad (4)$$

is obtained.

According to surveys of actual machinery and results of analysis by the inventors, in actual operation, plastic deformation of the carriage frames, the cooling effect of the water-sealing system, etc. cause this slant θ to be reduced to about half. Due to this, in actual settings, it is sufficient to use a spacer length (clearance) of the following formula (5) multiplying the results of calculation of δ with a coefficient of 0.5:

$$\delta \geqq 0.5 \times \alpha \times \Delta T \times W' l/L \quad (5)$$

Further, the upper limit may be made 50 mm from the viewpoint of prevention of dropping of refractories etc. carried between two carriages.

The propulsion system 30, as shown in FIG. 2, attaches wheels 32 at the inner circumference furnace wall 2 side and wheels 33 at the outer circumference furnace wall 3 side at the bottoms of the respective carriage frames 12. On a foundation 36 below the carriage frames 12, rails 34 over which the wheels 32 and 33 roll are laid in rings around the furnace center.

Figure 6A:
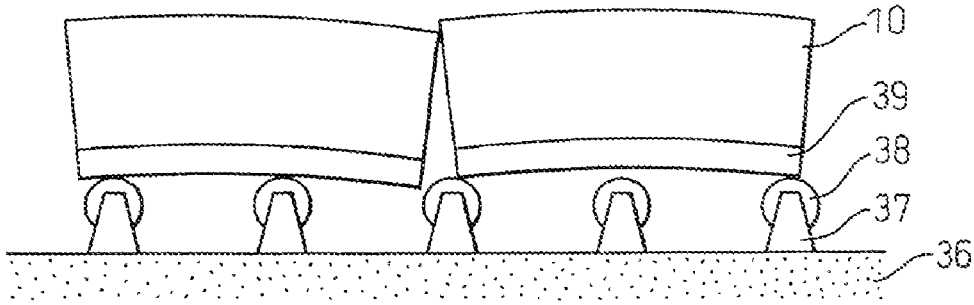
FIG. 6(*a*) and FIG. 6(*b*) schematically show the difference in action of a propulsion system depending on the mounting positions of the wheels.
Figure 6B:
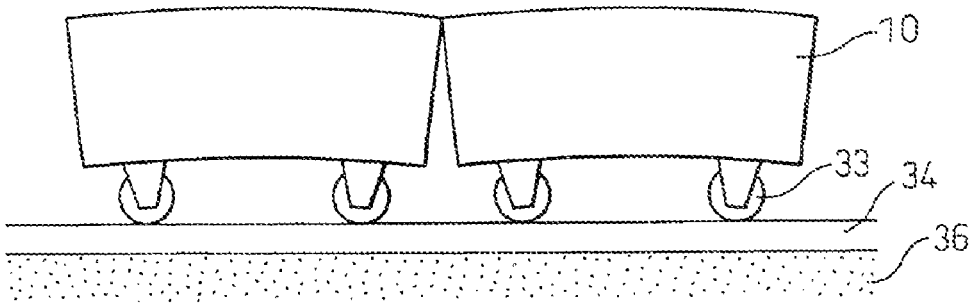

The hearth carriages are required to smoothly roll over the rails, but as shown in FIG. 6(*a*), when wheels 38 are attached to the foundation 36 via bearing stands 37 and the rails 39 are provided at the bottoms of the hearth carriages 10, the clearance between the carriages, which will expand upon heat deformation, will end up causing discontinuities in the contact of the wheels 38 and rails 39. This shows that impact will occur due to the constant step difference between the wheels 38 and rails 39. Over the long term, these will lead to fatigue breakage. To avoid this, in the present invention, as shown in FIG. 6(*b*), the wheels 32 and 33 are provided at the bottoms of the hearth carriages 10.

Figure 7:
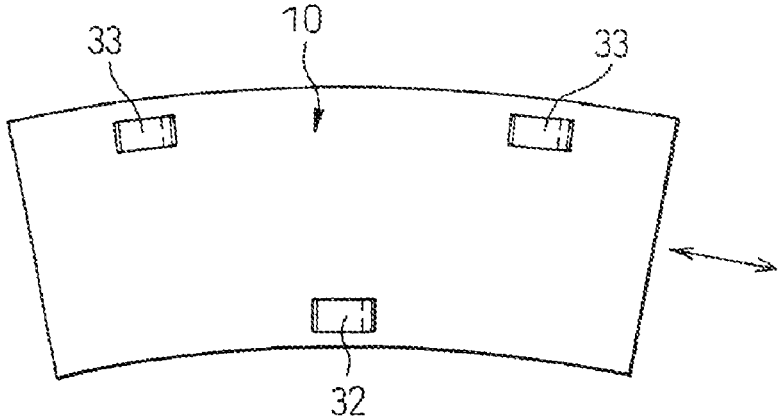
FIG. 7 is a view explaining heat deformation of a hearth carriage of the present invention.

Further, in each hearth carriage 10, as shown in FIG. 7, two of the wheels 32 or 33 are arranged at the outer circumference furnace wall side and one at the inner circumference furnace wall side or vice versa. By arranging the wheels 32 and 33 in this way, all of the wheels reliably contact the rails 34 at all times. As a result, the hearth carriages 10 are stably supported by the wheels 32, 33 and are propelled smoothly, so the hearth carriages 10, wheels 32 and 33, and rails 34 will not break due to fatigue.

Figure 8:
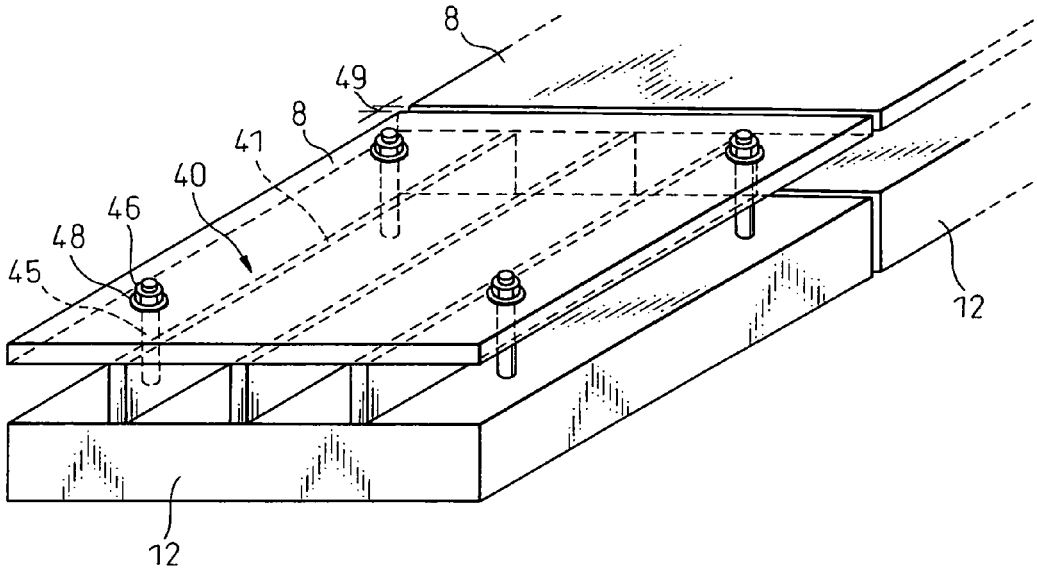
FIG. 8 is a perspective view schematically showing an example of carriage top plate support hardware of the present invention.

FIG. 8 shows an example of the carriage top plate support hardware 40. Each carriage top plate support hardware 40 is comprised of an elongated plate. A plurality of them are fastened with the plate surfaces vertical on the top surface of the carriage frame 12 of the hearth carriage 10. The carriage top plate support hardware 40 extends along the longitudinal direction of the hearth carriage 10 (circumferential direction) across the entire length of the carriage. A suitable margin for expansion is provided with the adjoining carriage top plate support hardware 40. The carriage top plate support hardware 40 has a height of 25 to 150 mm and a width of 9 to 32 mm or so. At the top surface of the carriage top plate support hardware 40, the carriage top plate 8 is attached to be able to displace relative to the support hardware and provided with a suitable margin for expansion 49 with the adjoining carriage top plate.

At the top surface of the carriage frame 12, holding bolts 45 are fastened. The carriage top plate 8 is provided with bolt holes (not shown) larger than the diameters of the holding bolts 45. Into the bolt holes, the top ends of the holding bolts 45 are passed. At the top ends of the holding bolts 45, the nuts 46 are fit. Washers 48 are interposed between the carriage top plate 8 and the nuts 46. The nuts 46 are loosely fastened so that the carriage top plate 8 and carriage top plate support hardware 40 can mutually displace. Space for the top ends of the holding bolts 46 sticking out from the top surface of the carriage top plate 8 and the nuts 46 to enter is provided at the bottom of the hearth refractories (not shown) of the refractory bed 6. As the refractory floor support hardware 40, a material having a heat resistance temperature of 200 to 250° C. or more and superior in mechanical properties is suitable. In general, one made of a ferrous metal is preferable.

In hearth carriages 10 having such configured carriage top plate support hardware 40, when the hearth carriages 10 deform due to heat, the carriage top plates 8 and the carriage top plate support hardware 40 mutually displace, so this heat deformation does not cause deformation or application of external force to the refractory bed 6 or the carriage top plates 8 and breakage of the hearth refractories on the refractory bed 6 can be avoided. Further, the holding bolts 45 restrict the displacement of the carriage top plates 8 and the carriage frame 12 and prevent large offset between the two.

Figure 9:
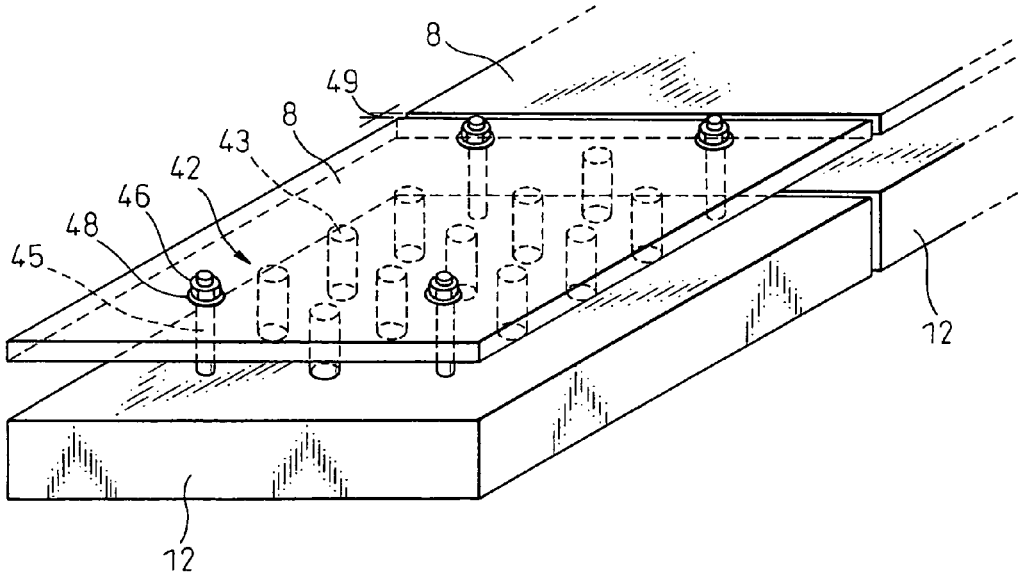
FIG. 9 is a perspective view schematically showing another example of carriage top plate support hardware of the present invention.
Figure 10:
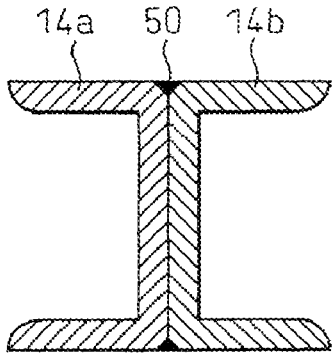
FIG. 10 is a view showing an example of a coupling structure of a conventional hearth carriage.

FIG. 9 shows another example of the carriage top plate support hardware. The carriage top plate support hardware 42 is comprised of a short cylindrical column or angular column and is attached vertically to the top surface of the hearth carriage 10. A plurality of the carriage top plate support hardware 42 is arranged along the longitudinal direction of the hearth carriage 10 across the entire length of the carriage. The height is 10 to 125 mm, and the diameter (angular) is 50 to 100 mm or so. The carriage top plates 8 are carried on the top surfaces 43 of the carriage top plate support hardware 42. The carriage top plates 8 and the carriage top plate support hardware 42 are able to displace with respect to each other. The configurations of the holding bolts 45 and the actions of the carriage top plate support hardware 42 are the same as those shown in FIG. 8.

Between the hearth carriages 10 and the furnace walls 2 and 3, a ring-shaped water sealing system 9 centered about the furnace center is provided. The water sealing system 9 prevents the high temperature furnace gas from leaking outside the furnace or the atmosphere from entering from outside the furnace to the inside of the furnace and harming the reducing atmosphere in the furnace.

INDUSTRIAL APPLICABILITY

According to the present invention, the plurality of hearth carriages forming a rotary furnace hearth are coupled by bolts and nuts so as to be able to freely move with respect to each other, so even when the hearth carriages deform due to heat, the wheels will all contact the ground and rotate. Due to this, it is possible to avoid carriage breakage or accidents due to excessive load and not necessary to adjust the amount of fastening of the bolts and nuts with each temperature change at the time of heating or cooling. The invention accordingly has a great industrial applicability.

The invention claimed is:

1. A hearth carriage coupling structure of a rotary furnace hearth characterized in that a hearth carriage carrying a hearth comprises a plurality of hearth carriages respectively having propulsion systems and in that adjoining hearth carriages are coupled by coupling bolts and nuts via spacers interspaced in a single row in a horizontal plane.

2. A hearth carriage coupling structure of a rotary furnace hearth as set forth in claim 1, characterized in that a length of the spacers δ is made a length derived by the following formula:

$$\delta \geqq 0.5 \times \alpha \times \Delta T \times W \times l / L$$

α: Coefficient of linear expansion of main material of carriage frames

ΔT: Temperature difference between top surface and bottom surface of carriage frames at time of operation W: Length of carriages l: Distance from top surface of carriages to spacer (coupling bolt) mounting holes L: Height of carriage frames.

3. A hearth carriage coupling structure of a rotary furnace hearth as set forth in claim 1 or 2, characterized in that wheels for movement of the hearth carriages are provided at the bottom of the hearth carriages and two are arranged at an outer circumference furnace wall side of each hearth carriage and one is arranged at an inner circumference furnace wall side or vice versa.

4. A hearth carriage coupling structure of a rotary furnace hearth as set forth in claim 1, characterized in that a hearth refractory bed and the hearth carriages are separately provided and are coupled displaceably with each other.

* * * * *